US006220821B1

(12) United States Patent
Kern et al.

(10) Patent No.: US 6,220,821 B1
(45) Date of Patent: Apr. 24, 2001

(54) ION PUMP HAVING PROTECTIVE MASK COMPONENTS OVERLYING THE CATHODE ELEMENTS

(75) Inventors: Robert H. Kern, Danvers; Kevin D. Hosman, Haverhill, both of MA (US)

(73) Assignee: Kernco, Incorporated, Danvers, MA (US)

( * ) Notice: Subject to any disclaimer, the term of this patent is extended or adjusted under 35 U.S.C. 154(b) by 0 days.

(21) Appl. No.: 09/314,979

(22) Filed: May 20, 1999

(51) Int. Cl.[7] ..... F04B 37/02
(52) U.S. Cl. ..... 417/48
(58) Field of Search ..... 417/49, 48, 50; 378/137; 73/19; 250/290

(56) References Cited

U.S. PATENT DOCUMENTS

| | | | | |
|---|---|---|---|---|
| 3,460,745 | * | 8/1969 | Lamont, Jr. | 417/49 |
| 4,047,102 | * | 9/1977 | Welch | 324/33 |
| 4,373,375 | * | 2/1983 | Terhune et al. | 73/19 |
| 4,460,317 | * | 7/1984 | Kern et al. | 417/49 |
| 5,304,799 | * | 4/1994 | Kurzweg | 250/296 |
| 5,682,412 | * | 10/1997 | Skillicorn | 378/98.6 |

* cited by examiner

*Primary Examiner*—Charles G. Freay
(74) *Attorney, Agent, or Firm*—Barry R. Blaker

(57) ABSTRACT

Disclosed herein is an ion pump construction having constructional components to avoid etch through failure of the vacuum housing and, additionally, constructional features to reduce the latent period within which the ion pumping function is initiated.

12 Claims, 2 Drawing Sheets

ION PUMP HAVING PROTECTIVE MASK COMPONENTS OVERLYING THE CATHODE ELEMENTS

BACKGROUND OF THE INVENTION

This invention relates generally to ion pumps and is more particularly concerned with an ion pump construction in which gas leakage failure due to the phenomenon of ion etching through the vacuum housing component thereof is prevented and in which the latent period prior to the onset of ion pumping is accelerated.

Ion pumps are well known devices utilized for purposes of creating, maintaining and/or gauging vacuums in various technical systems. In general, an ion pump comprises: a vacuum housing composed of a non-ferromagnetic metal, usually a stainless steel or monel, and equipped with gas inlet means; a magnet system external of the housing for providing a magnetic field therewithin, said field defining a magnetic axis traversing the housing; an internal anode positioned substantially centrally within the housing aligned with the magnetic field and an internal cathode comprising opposed reactive sheet metal elements spaced from opposite ends of said anode and being interposed between the anode and the housing, said reactive elements overlying the magnetic axis. In use, usually after mechanically pumping the system to an at least somewhat reduced pressure, a high voltage is impressed across the anode and cathode, thereby to excite and ionize the gas admitted into the housing. Due to the influence of the magnetic field, the resulting positive ions are focussed as a core stream surrounding the magnetic axis of the field and flow to the negatively charged reactive sheet metal cathode elements to impinge upon, react with and thus become implanted as solid products of reaction therein. Generally, the cathode and housing are in electrical communication with one another and both are held at ground potential. Titanium is often the reactive metal employed for the construction of the reactive sheet metal cathode elements. Exemplary of such ion pump constructions is that disclosed in U.S. Pat. No. 4,460,317, to Robert H. Kern and Wilfred P. Levesque, entitled ION PUMP, issued Jul. 17, 1984, the entire disclosure of which is incorporated herein by reference.

One of the problems associated with ion pumps of the prior art is that, over time, the highly focussed ions contacting the reactive sheet metal cathode elements, particularly ionized noble gases concentrated as a core stream along the magnetic axis, ultimately etch holes through one or both said elements whereupon at least a portion of the streaming ions thereafter flow through the so holed reactive cathode elements to impinge upon and ultimately etch holes through the overlying walls of the vacuum housing. This last, of course, results in gas leakage through the vacuum housing and catastrophic failure of the pump. The problem is particularly acute where the gas to be pumped comprises one or more of the relatively readily ionized noble gas species, in other words, helium, neon, argon, krypton, radon or xenon. Noble gas ions tend to be highly reactive with respect to those metal compositions conventionally employed as materials of construction for the vacuum housing component. The predominant gas pumped in the many known ion pump applications is normal atmosphere, which, of course, contains such noble gas species. Accordingly, the foregoing mode of depletion and then subsequent failure of the housing represents a problem in the ion pump art.

Another operational problem in ion pumps of the prior art resides in the inherent occurrence of an initial, relatively lengthy, latent non-pumping period after impressing the high voltage across the anode and cathode components. This latent period is due to the fact that a certain amount of time is required to allow the high potential electric field across anode and cathode to experience initial ionization of a sufficient population of gaseous atoms and molecules to bring about the onset of a discharge in the feed gas and to thereby allow the pumping sputtering function to begin. This latent period is variable due to pressure and varying times to initial ionization. Where the application of the pump is in a system which is used repetitively throughout the work day, such as in a mass spectrometer of an analytical laboratory, these initial latent non-pumping periods can constitute troublesome delays, from seconds to periods approaching an hour.

In accordance with the present invention, the foregoing problems associated with ion pumps of the prior art have either been entirely eliminated or, at the least, substantially ameliorated.

SUMMARY OF THE INVENTION

In accordance with the invention there is provided an ion pump comprising a vacuum housing; a magnet system external of said housing for providing a magnetic field therewithin, said magnetic field defining a magnetic axis traversing the housing; an internal anode aligned within said magnetic field and an internal cathode having opposed reactive sheet metal elements spaced from the respective ends of said anode and being interposed between said anode and said housing, said reactive cathode elements being disposed over said magnetic axis. The improvement of the invention comprises a pair of protective mask components, each composed of a material inert with respect to the ion sputtering indigenous to ionized noble gases. These mask components are interposed between the respective ends of said anode and the opposed sides of said housing overlying said reactive sheet metal cathode elements, said protective mask components being located so as to intercept the concentrated core ion stream focussed along the central magnetic axis. In another aspect of the invention there is located within the housing at least one component comprising an alpha particle emitting substance. In an additional embodiment, at least one of the foregoing opposed protective mask components is conformed of an inert material comprising an alpha particle emitting substance. In yet another embodiment of the invention, said pair of inert protective mask components are each composed of an electrically conductive material, are each conformed with a conically shaped face and are affixed to the opposed reactive sheet metal cathode elements with the conical faces thereof protruding inwardly from the inner surfaces of said reactive sheet metal cathode elements, the apices of said conical faces facing the anode and being substantially coincident with the magnetic axis.

DESCRIPTION OF THE PREFERRED EMBODIMENTS

Figure 1:
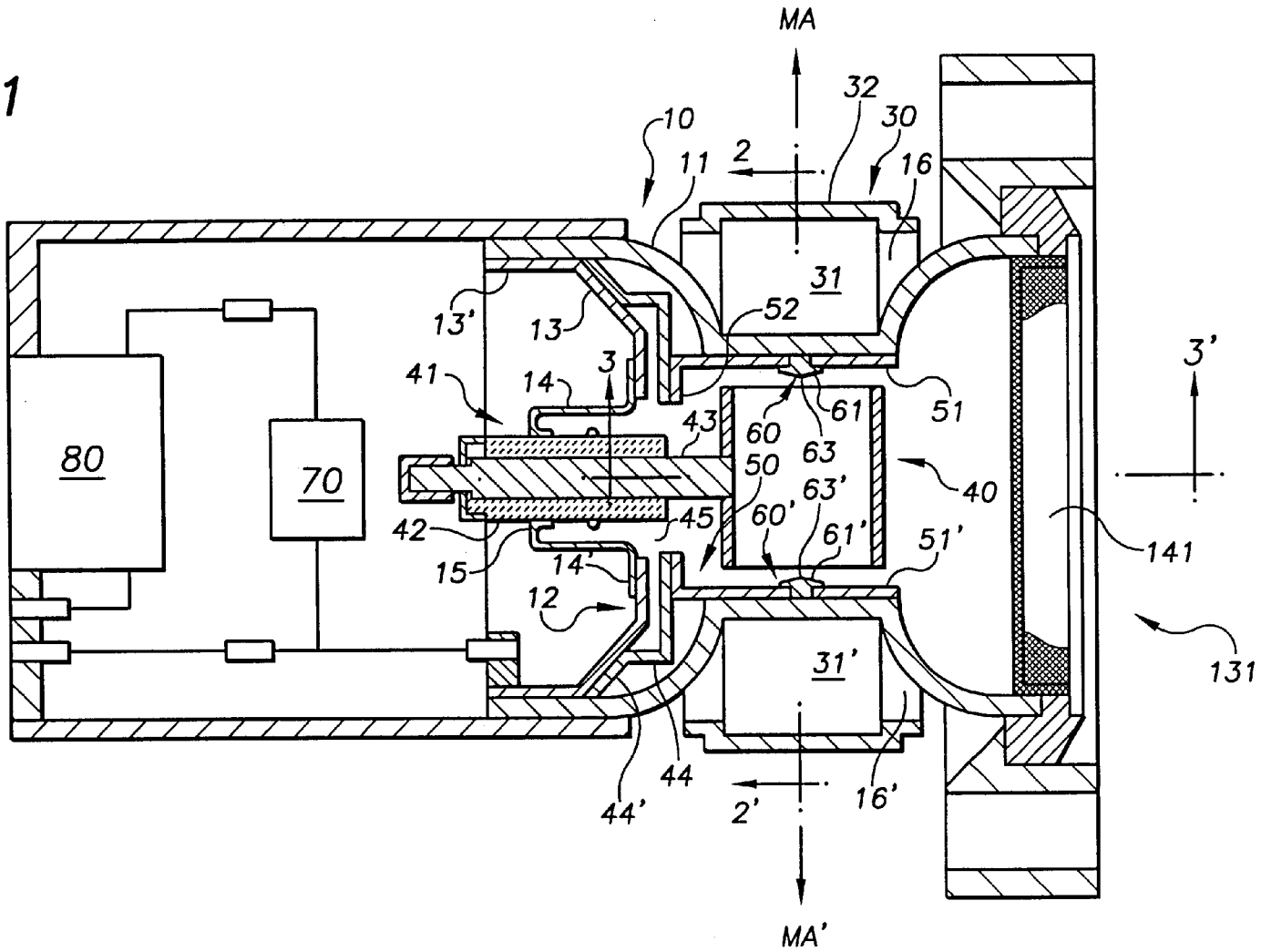
FIG. 1 hereof is a schematic, diagrammatic, sectional side view of an ion pump in accordance with the invention, showing various preferred embodiments thereof.
Figure 2:
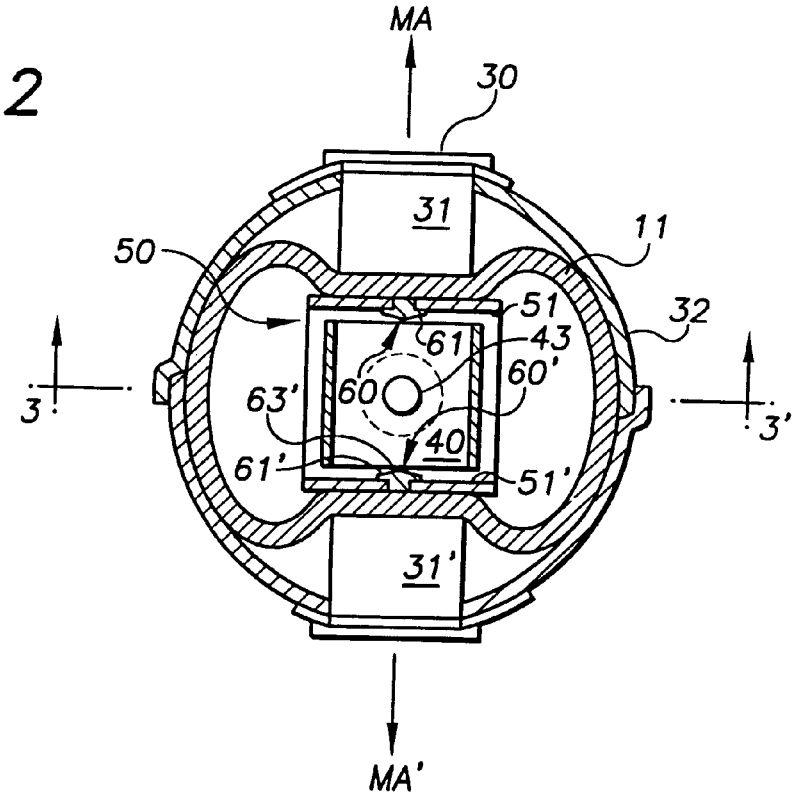
FIG. 2 is a schematic, diagrammatic, sectional end view of the ion pump of FIG. 1 taken through line 2–2' thereof, the plane defined by said line 2–2' being coincident with the magnetic axis MA–MA'.
Figure 3:
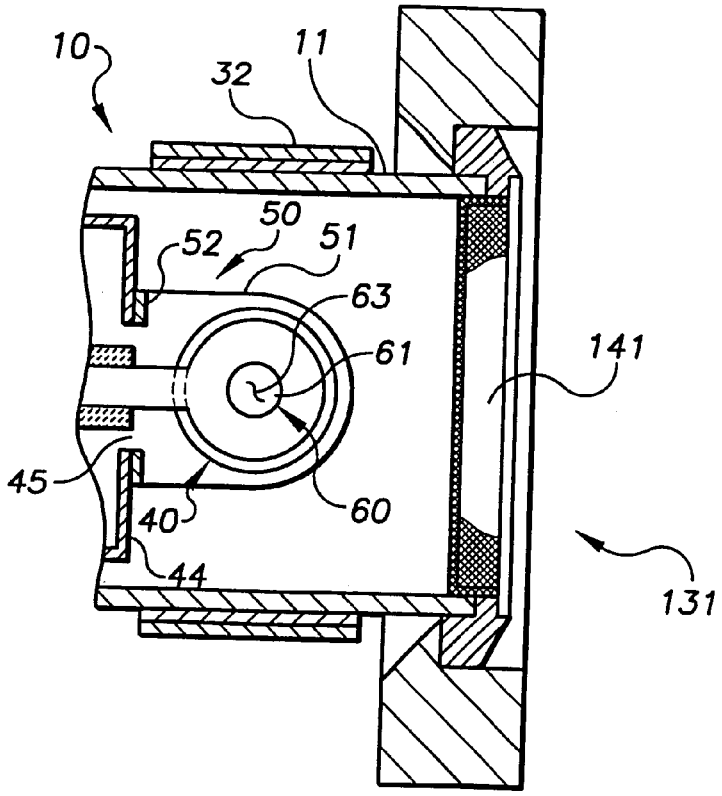
FIG. 3 is a schematic, diagrammatic, sectional bottom view of a portion of the ion pump of FIGS. 1 and 2, taken through lines 3–3' thereof.

Referring now to FIGS. 1 through 3, wherein like reference numerals refer to like structures, the ion pump of the invention comprises a vacuum housing 10, an external magnet system 30 for providing a magnetic field within said housing 10, said magnetic field defining a magnetic axis MA–MA' traversing said housing, an internal anode 40 disposed within said magnetic field and an internal cathode 50 comprising a pair of opposed reactive sheet metal cathode elements 51, 51', said elements being spaced from opposite ends of said anode 40 and being disposed across the magnetic axis MA–MA'.

The vacuum housing 10 comprises a tubular housing 11 composed of a non-ferromagnetic material such as a monel or stainless steel alloy and back closure 12. The back closure 12 comprises a forwardly extending cup-shaped member 13 whose outer rim 13' is continuously welded to the interior surface of the back edge of tubular housing 11 and, coaxial with said member 13, a rearwardly extending central cup-shaped member 14 whose outer rim 14' is continuously welded to said cup-shaped member 13. The rearwardly facing central cup-shaped member 14 comprises an aperture 15 through which there is sealingly mounted a high voltage feed through means 41 comprising a ceramic insulator jacket 42 and a high voltage conductor core 43 which extends forwardly beyond the front edge of said insulator jacket 42. A cup-shaped sputter shield 44 having a central aperture 45 of somewhat larger diameter than the ceramic insulator jacket 42 of feed through means 41 is welded at its outer rim 44' to the frontal surface of the back closure 12, the aperture 45 thereof overlying and being coaxially spaced from the front end of said ceramic insulator jacket 42. Said sputter shield 44 mitigates against deposition of ionization sputter products onto the surface of the insulator jacket 42. Such deposition of sputter products on the insulator jacket 42, particularly on the back portion thereof, can eventually lead to electrical leakage therethrough. Additionally, the vacuum housing 10 also comprises a gas inlet means 131 which, in the specific embodiment shown, comprises an axial inlet 141 opening into the front end of the tubular housing 11. Obviously, however, the gas inlet means 131 into the vacuum housing 10 can comprise many alternative arrangements, such as one or more tubular inlets entering vacuum housing 10 through the sides of tubular housing 11. Of course, where such alternative gas inlet means are employed, the front end of the tubular housing 11 will be suitably sealed, such as by means of a front closure continuously welded about the front end thereof.

Lying exterior of the vacuum housing 10 and secured thereto is a magnet system 30 which provides a magnetic field within said housing, said magnetic field defining a magnetic axis MA–MA' running transversely across the interior thereof. In the particular embodiment of the invention shown said magnet system 30 comprises a pair of identical opposed permanent magnets 31, 31' which reside in an opposed pair of recesses 16, 16' formed in the tubular housing 11 of vacuum housing 10 and in which respective recesses 16, 16' said identical cylindrical permanent magnet 31, 31' are secured by means of a circumscribing yoke 32.

Disposed within the vacuum housing 10 and affixed to the inner end of the conductor core 43 of the high voltage feed through means 41 is a generally tubular metallic anode 40, said tubular anode being located within the magnetic field and being coaxially oriented about the magnetic axis MA–MA'.

Also contained within the vacuum housing 10 is a generally U-shaped cathode 50, said cathode 50 comprising a base leg 52 and a pair of side members defined by opposed reactive sheet metal cathode elements 51, 51'. The base leg 52 is welded to the frontal surface of sputter shield 44, thereby to establish a common electrical ground with the vacuum housing 10. The reactive sheet metal cathode elements 51, 51' extend forwardly from the base leg 52 and are spaced from the respective ends of said anode 40, said reactive sheet metal cathode elements 51,51' lying substantially adjacent the respective interior surfaces of the tubular housing 11 underlying the opposed magnets 31, 31' and, additionally, being disposed over the magnetic axis MA–MA'.

In accordance with the invention, there is interposed between said anode 40 and the respective opposed interior surfaces of the tubular housing 11 underlying the opposed magnets 31, 31' a pair of opposed disk conical or button-shaped protective mask components 60, 60', each said mask component intercepting the magnetic axis MA–MA'. Each said mask component 60, 60' is composed of a ceramic or metallic material which is inert with respect to the ion bombardment within the vacuum housing 10. Preferably, the protective mask components 60, 60' are each composed of an electrically conductive material and even more preferably are composed of an inert metal, such as tungsten. It is the principal purpose of the inert protective mask components 60, 60' to protect the vacuum housing 10 from contact with the concentrated gaseous ions streaming along the magnetic axis MA–MA' and to thereby prevent ion etching of said housing. Accordingly, the diameters of the mask components 60, 60' should be sufficient to achieve this purpose and appropriate diameters for any given pump construction can be readily selected based upon knowledge of the cross sectional dimension of the concentrated ion stream flowing along said magnetic axis MA–Ma'. Upon contact with said inert mask components, the ions are deflected therefrom, thereby to ultimately come into contact with and become implanted in those portions of the reactive sheet metal cathode elements 51, 51' which lie outside the magnetic axis MA–MA'. Those ions which do not come into contact with the reactive sheet metal cathode elements 51, 51' during their first pass through the pump are simply recycled therethrough and are, therefore, eventually implanted into said reactive elements. Accordingly, while the protective inert mask components 60, 60' may be affixed to the ion pump construction in any manner and position suitable for intercepting and deflecting the ions streaming towards the vacuum housing 10 along the magnetic axis MA–MA', such as by fixation thereof directly to the interior surface of the tubular housing 11, it is preferred that said mask components be affixed to the facing surfaces of the opposed reactive sheet metal cathode elements 51, 51' underlying the tubular housing 11, as shown. In this way, both the tubular housing 11 and the cathode elements 51, 51' are protected from ion etching therethrough by the concentrated ion stream flowing along the magnetic axis MA–MA' and, as will be explained in detail hereinafter, an additional benefit relating to the reduction of the latent non-pumping period can also be achieved. It is yet further preferred that at least one, and preferably both, inert protective mask components 60, 60' be composed of an inert material which contains an alpha particle emitting substance therein. Thoriated tungsten, containing between about 0.5 and about 4% by weight thoria is a preferred example of such an inert material containing an alpha particle emitting substance. Such thoriated tungsten compositions are commercially available in the form of cylindrical welding rods which can be readily machined into one or both protective mask components 60, 60' of the invention. When the inert material utilized for at least one of the protective mask components 60, 60' comprises such an alpha particle emitting substance, the low level alpha particle radiation emitted therefrom acts to independently and rapidly initiate ionization of the gas admitted into the vacuum housing 10, thereby shortening the aforedescribed latent non-pumping period. Of course, if desired, said ionization initiation benefit can also be achieved by installing a separate alpha particle emitting component, distinct and physically divorced from either or both of the protective mask components 60, 60', within the vacuum housing 10. However, the addition of an added alpha particle emitting component, separate and distinct from one or both protective mask components 60, 60' of the invention, obviously entails additional complexity of construction and design and additional fabrication time and expense. In another preferred embodiment of the invention, the protective disks 60, 60' are: (a) each composed of a conductive material; (b) opposed faces 61, 61' thereof are conically shaped and (c) said disks are mounted to the facing surfaces of the opposed reactive sheet metal cathode elements 51, 51' such as to protrude slightly inwardly therefrom with the apices 63, 63' of their opposed conical faces 61, 61' being substantially coincident with the magnetic axis MA–MA'. By meeting this last-mentioned combination of constructional criteria it will be seen that the path length between each of the apices 63, 63' and its respective end of anode 40, being slightly less than the path lengths between the facing surface of each of the reactive sheet metal cathode elements 51, 51' and its respective end of the anode 40, gives rise to a beneficial field emission contribution whereby the time to initiation of ion pumping of the gas admitted to vacuum housing may be further reduced by the advent of electrons resulting from field emission. Utilizing thoriated tungsten disks 60, 60' in combination with the preferred conical geometry thereof and the fixation of said disks to the facing surfaces of the reactive sheet metal cathode elements 51, 51', with the apices 63, 63' being coincident with the magnetic axis MA–MA' ion pumping has been consistently initiated within seconds after the high voltage potential has been impressed across the anode and cathode.

Ancillary equipment to service the ion pump of the invention includes a high voltage power supply 70 equipped with suitable circuitry to establish a high potential field between the anode 40 and the cathode 50. As is conventional, the high voltage power supply 70 is supplied with a low voltage input from an external source, not shown. Optionally, the low voltage current draw of the high voltage power supply 70 is monitored by means of a microammeter 80 which is desirably provided with a logarithmic scale whereby, as is conventional in the ion pump art, a direct pressure reading within the vacuum housing 10 may be had.

While the foregoing description demonstrates certain embodiments of the invention and techniques for implementation and use thereof, it should be recognized and understood that said description is not to be construed as limiting of the invention because many obvious changes, modifications and variations may be made therein without departing from the essential scope and spirit thereof. Accordingly, it is intended that the invention is to be limited only by the scope of the appended claims.

What is claimed is:

1. An ion pump comprising:

a vacuum housing, including at least one gas inlet means thereinto;

a magnet system to provide a magnetic field within said housing, said magnetic field defining a magnetic axis traversing said housing to focus the ion stream therealong;

an anode positioned within said magnetic field;

a cathode internal of said housing and comprising opposed reactive sheet metal cathode elements spaced from the respective ends of said anode and being interposed between said anode and said housing, said reactive cathode elements being disposed over said magnetic axis; and a pair of protective mask components, each composed of a material inert with respect to ion bombardment and being interposed between the respective ends of said anode and the opposed sides of said vacuum housing overlying said reactive sheet metal cathode elements, said mask components being located so as to intercept the focussed ion stream flowing along the magnetic axis and to thereby prevent contact of said ion stream with said vacuum housing.

2. The ion pump of claim 1 wherein one of the pair of protective mask components is affixed to the interior surface of one of said opposed reactive sheet metal cathode elements and the other of said pair of protective mask components is affixed to the interior surface of the other of said opposed reactive sheet metal cathode elements and wherein both protective mask components overlie said magnetic axis.

3. The ion pump of claim 2 wherein each said protective mask component is composed of an electrically conductive material.

4. The ion pump of claim 3 wherein said electrically conductive material is tungsten.

5. The ion pump of claim 3 wherein said protective mask components are disk shaped, wherein the facing surfaces thereof project inwardly toward the anode from the interior surfaces of said opposed reactive sheet metal cathode elements, wherein said facing surfaces are conically shaped and wherein the apices of said conically shaped facing surfaces are located substantially coincident with said magnetic axis.

6. The ion pump of claim 1 wherein at least one of said pair of protective mask components is composed of an inert material containing an alpha particle emitting substance.

7. The ion pump of claim 6 wherein said alpha particle emitting substance is thoria.

8. The ion pump of claim 6 wherein said inert material is thoriated tungsten containing between about 0.5 and about 4% by weight thoria.

9. The ion pump of claim 6 wherein both of said pair of protective mask components is composed of an inert material containing an alpha particle emitting substance.

10. An ion pump comprising a vacuum housing, including at least one gas inlet thereinto;

an external magnet system for providing a magnetic field within said housing;

an anode positioned within said magnetic field;

a cathode, including spaced apart reactive sheet metal cathode elements spaced from the respective ends of said anode for collecting ions impinging thereon; and a component composed of a material containing an alpha particle emitting substance located within said housing for providing initiation of ionization gas present in said vacuum housing.

11. The ion pump of claim 10 wherein said alpha particle emitting substance is thoria.

12. The ion pump of claim 10 wherein said material is thoriated tungsten containing between about 0.5 and about 4% by weight thoria.

* * * * *